United States Patent [19]

Houser et al.

[11] Patent Number: 4,755,112

[45] Date of Patent: Jul. 5, 1988

[54] WATER/AIR PUMPING SYSTEM

[76] Inventors: John R. Houser, River Rte. Box 16-A, Magnolia Springs, Ala. 36555; Joseph B. Childress, HC-79 Box 820, Gulf Shores, Ala. 36542

[21] Appl. No.: 81,791

[22] Filed: Aug. 5, 1987

[51] Int. Cl.[4] ..... F04B 23/04; E03B 7/10

[52] U.S. Cl. ..... 417/440; 417/523; 417/529; 137/59; 138/28

[58] Field of Search ..... 417/238, 434, 437, 440, 417/442, 503, 523, 529, 38; 137/59; 138/28

[56] References Cited

U.S. PATENT DOCUMENTS

| | | | |
|---|---|---|---|
| 324,438 | 8/1885 | Waters | 417/529 |
| 419,248 | 1/1890 | Dow | 417/503 |
| 640,488 | 1/1900 | Philpott | 417/529 |
| 1,150,803 | 8/1915 | Applegate | 417/565 |
| 1,350,926 | 8/1920 | Franc | 417/309 |
| 1,522,381 | 1/1925 | Murphy | 417/442 X |
| 1,555,192 | 12/1921 | Dennedy | 417/539 |
| 1,559,365 | 10/1925 | Pepper | 417/536 |
| 1,833,003 | 11/1931 | Spencer | 138/28 |
| 2,091,499 | 8/1937 | Brown | 417/437 |
| 2,139,972 | 12/1938 | Rokkjar | 417/523 |
| 2,273,505 | 2/1942 | Florian | 138/28 |
| 2,394,191 | 2/1946 | Leake | 417/44 |
| 2,650,545 | 9/1953 | Cornelius | 417/539 |
| 2,667,842 | 2/1954 | Shallenberg | 138/28 X |
| 2,777,397 | 1/1957 | Atkinson | 417/557 |
| 2,816,515 | 12/1957 | Senkowski et al. | 417/440 |
| 3,185,103 | 5/1965 | Yohpe | 417/568 |
| 3,563,671 | 2/1971 | Weber | 417/38 |
| 3,666,382 | 5/1972 | Rasmussen | 417/533 |
| 4,571,159 | 2/1986 | Beardmore | 417/540 |

FOREIGN PATENT DOCUMENTS

| | | | |
|---|---|---|---|
| 31428 | 1/1908 | Austria | 417/440 |

*Primary Examiner*—Carlton R. Croyle
*Assistant Examiner*—Paul F. Neils
*Attorney, Agent, or Firm*—A. Robert Theibault

[57] ABSTRACT

The present disclosure is directed to a water/air pumping system comprising essentially a substantially flat primary reservoir, a header tank and a pump. At least one reciprocating piston is powered through the tank. Eccentric drive cams are directly connected to the motor driven shaft and are connected to drive the pistons to pump water or air from the reservoir into the tank. A water and or air supply connection is horizontally connected to the reservoir and is provided with a water/air control valve proximate the reservoir. A tank discharge connector is connected to a water or air service system through the side wall of the tank externally thereof, above the motor driven shaft and its direct drive connection with the pistons for lubricating the driving mechanism. An air inlet valve is situated in the external wall of the primary reservoir beneath the piston intake so that the pump may pump either air or water.

9 Claims, 5 Drawing Sheets

WATER/AIR PUMPING SYSTEM

TECHNICAL FIELD

The present invention is directed to a water and/or air pump and pumping system wherein at least one piston is mounted in a cylinder with the cylinder intake disposed in a substantially flat base reservoir and the cylinder discharges in the bottom of a system header tank. The piston is driven by eccentrics connected directly to a drive shaft passing through the header tank and being motor driven by a drive from a motor of the electric, hydraulic or gear type. The header tank discharge to the water system being supplied by the pump is above the pump drive shaft to assure water lubrication to the pump piston and drive shaft to avoid heating and parts seizure. The base reservoir has an air inlet entering through the side wall and communicating with the air to the cylinder intake.

The water supply is introduced to the primary reservoir through a water line connected to the reservoir through the side wall of the base reservoir. A variable inflatable bladder may be positioned in the header tank above the cylinder discharge opening and the pump drive shaft when used in regions where freezing occurs.

BACKGROUND ART

The present invention is an improvement over the pumping system shown in the A. Leake U.S. Pat. No. 2,394,191 granted Feb. 5, 1946 as well as the following other U.S. Letters Patent:

| U.S. Pat. No. | DATE | NAME |
|---|---|---|
| 324,438 | 8-18-1885 | M. WATERS |
| 419,248 | 1-14-1890 | G. E. DOW |
| 640,488 | 1-2-1900 | J. S. PHILPOTT |
| 1,150,803 | 8-17-1915 | L. R. APPLEGATE |
| 1,350,926 | 8-24-1920 | JME FRANC |
| 1,555,192 | 9-29-1925 | J. H. DENNEDY |
| 1,559,365 | 10-27-1925 | B. J. PEPPER |
| 2,901,499 | 8-31-1937 | A. M. BROWN |
| 2,650,545 | 9-1-1953 | R. T. CORNELIUS |
| 2,777,397 | 1-15-1957 | H. J. ATKINSON |
| 2,816,515 | 12-17-1957 | A. SENKOWSRIETAL |
| 3,185,103 | 5-25-1965 | R. A. YOHPE |
| 3,563,671 | 2-16-1971 | A. V. WEBER |
| 3,666,382 | 5-30-1972 | R. F. RASMUSSEN |
| 4,571,159 | 2-18-1986 | J. M. BEARDMORE |

While some of the foregoing patents show pumps containing some of the elements of the claims of this application none contain all the elements of any independent claim hereof nor do they function in the same manner to attain the same end results.

DISCLOSURE OF THE INVENTION

An object of the present invention is to provide a pumping system having a substantially flat base reservoir receiving its variable supply of air in a water supply line entering the reservoir horizontally. At the top of the flat base reservoir, which may be flush mounted on a boat deck or counter top, as a plate dividing the reservoir from the header tank. Above the plate in the header tank and passing through the tank is a crank drive shaft journaled at each end to drive eccentrics which are directly connected to the drive shaft and which drive piston rod straps connected to the piston rods of the pistons to raise and lower them within the cylinders to pump water from the reservoir to the header tank.

Another object of the invention is to position the header tank discharge to the water service system through the header tank wall above the drive shaft and the piston drive eccentrics so that the water discharge or service connection supplied by the pump and tank to an external plumbing system for use in a dwelling such as a fishing camp, hunting lodge house or irrigation system or aboard a boat or camper or mobile home, will assure that the driving or moving parts of the pump will have lubrication. If the water supply is either low or out enough water will remain in the system to keep the moving parts lubricated so that no damage is done to the pump.

Another object of the present invention is the inclusion of a variable inflatable bladder in the header tank which may be compressed externally by ice forming from freezing of water in the tank or system which could result in rupture to either the tank wall or piping of the water distribution system. The bladder which may be compressed externally will guard against water logging.

A further object of the invention is to provide an air intake to the reservoir to permit closing off of the water supply to the reservoir and tank and to permit blowing out water from the distribution system when shutting down the camp, house, cabin, camper or boat for the winter. This is effectuated by closing the water supply, opening the air valve and allowing the pump to build up sufficient air pressure upon opening system outlets to blow out the distribution system. When the system is again to be placed in use the reverse proceedure will be followed, closing the system discharge valves, closing the intake valve to the reservoir and re-establishing the water supply to the primary reservoir.

Two size pump units have been shown, one large and one small dependent upon the volume of water and pressure needed.

While we have shown an electric motor as the prime mover for the pump it will be understood that pneumatic motors, hydraulic motors, gear motors or any source supplying driving energy to impart rotary motion to the drive shaft which causes the piston to reciprocate may be employed.

BEST MODE FOR CARRYING OUT THE INVENTION

Figure 1:
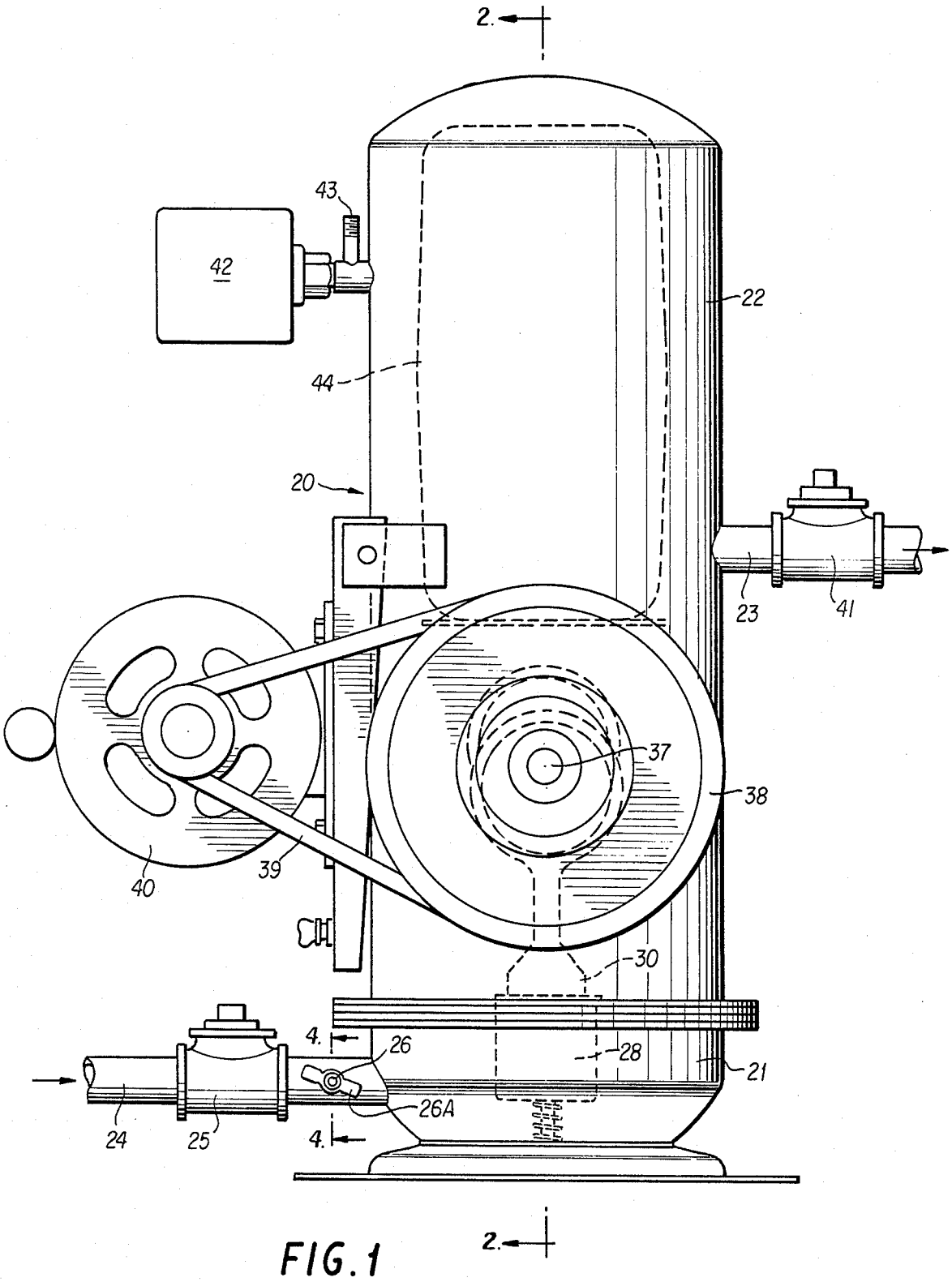
FIG. 1 is a side elevational view of one from of the pump of the present invention with parts shown in dash line.
Figure 2:
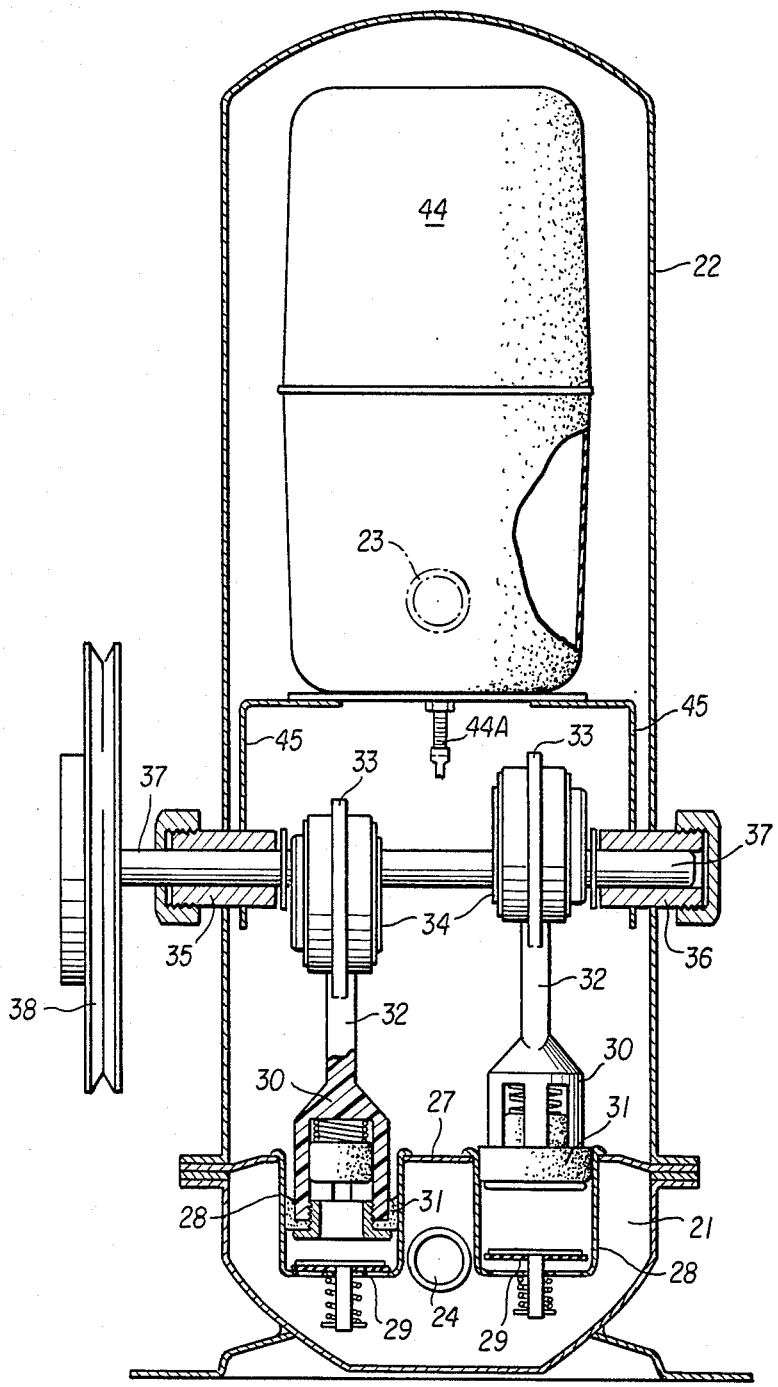
FIG. 2 is a vertical sectional view of the pump of FIG. 1 taken on the lines 2—2 in FIG. 1.
Figure 3:
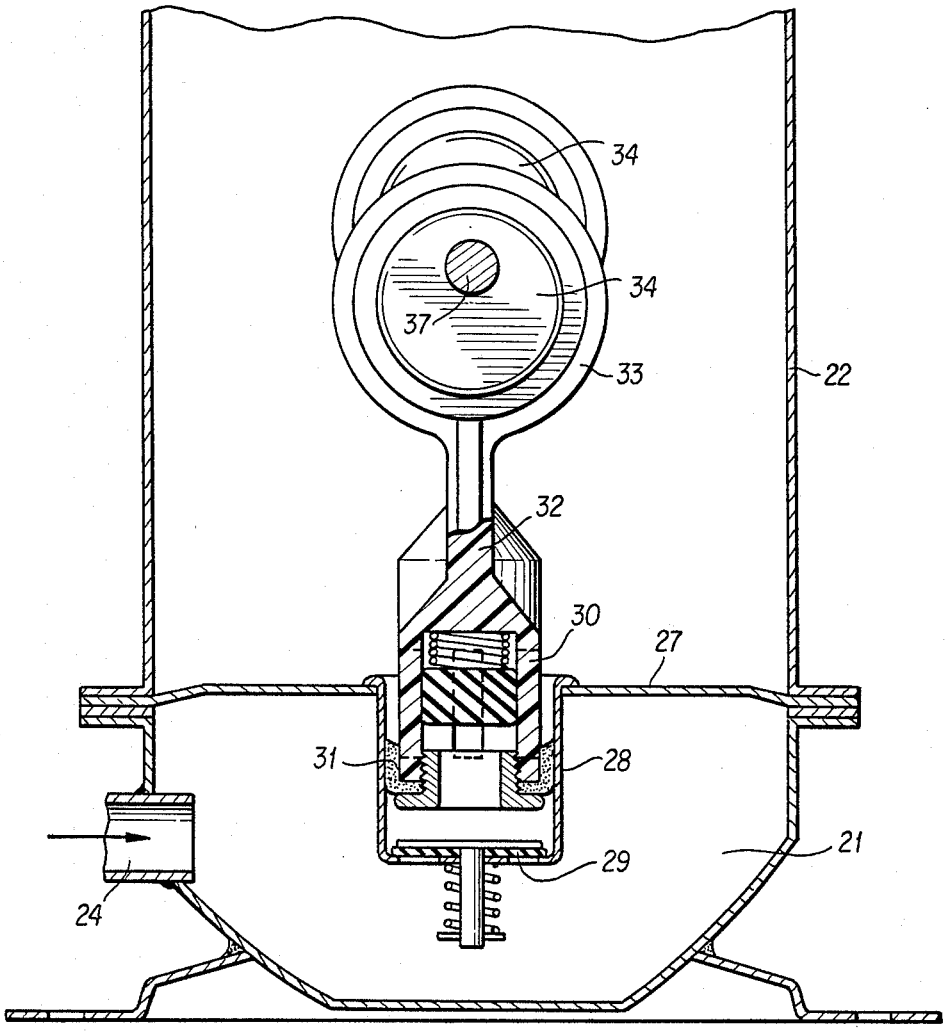
FIG. 3 is a vertical sectional view of the pump of FIG. 2 taken at an enlarged scale with parts broken away and parts shown in section from the side shown in FIG. 1.

Referring now to the drawings and for the moment to FIGS. 1 through 4, 20 designates the pump of the system having a flat base primary reservoir 21, a header tank 22 above the reservoir 21, and an outlet 23 from the tank 22 to a distribution system.

The reservoir 21 is substantially flat for flush mounting on the deck of a vessel, a counter top or bench and has a horizontal water supply line input 24 to a valve 25 supplied from a source such as a well at a fishing camp, house or hunting lodge, but may be from a tank stored source on a boat or cistern. An air valve 26 is provided to supply air to the reservoir for pumping to blow out the distribution system or for a service air connection to inflate or blow out objects. A plate 27 separates the reservoir 21 from the header tank 22 and supports the pump cylinders 28 as well as having spring loaded cylinder intake valves 29. Mounted for reciprocating pumping movement in the cylinders 28 are pistons 30 having leathers 31 at their lower ends and piston rods 32 at their upper ends which have straps 33 or cam throw journals to receive and be driven by eccentrics 34.

Passing through the header tank 22 and journaled for rotation at 35, 36 is a crank drive shaft 37 having a rotary water seal only on the pulley end. A cap is on other end. A V-drive pulley 38 is driven by a V-drive belt 39 or gear belt which is driven by an electric motor 40. The eccentrics 34 are secured to the crank drive shaft by set screws or splines in a well known manner so as to rotate with the shaft 37 since the eccentrics 34 are within the collar straps 33 or cam rod journals, which may have rubber insert bearings, the pistons 30 are reciprocated to pump water from the reservoir 21 to the header tank 22.

Located above the level of the drive shaft 37, straps 33 cam or rod journals and eccentrics 34, is a tank having a discharge nipple 23 connecting the header tank 22 with the distribution system such as sinks, toilets and showers. The positioning to the discharge nipple 23 above the working parts of the pump is to keep them immersed in water which acting as a lubricating medium will guard against their seizure due to lack of lubrication.

Also, positioned above the water level in tank 22 is a pressure switch 42 to regulate air pressure within the air dome of tank 22. An external air charging connection 43 is provided for inflating marine devices and blowing out filters and the like.

Also, located within the header tank 22 is a variable inflatable bladder 44 which may be charged at 44A to a pressure which permits it to be compressed by water in the tank 22 occassioned by freezing to avoid rupture of the tank wall. The bladder 44 is mounted on brackets 45 carried by the drive shaft journals 35, 36.

Referring to the embodiment of FIGS. 1 through 4, to pump water from a water supply line 24, the water supply valve 25 is opened and the air inlet valve 26 is closed. The service system supply valve 41 downstream of tank 22 is opened and the pump started.

To pump air in the embodiemnt of the invention shown in FIGS. 1 through 4, the water supply valve 25 is closed and the air vent valve 26 is opened.

Figure 5:
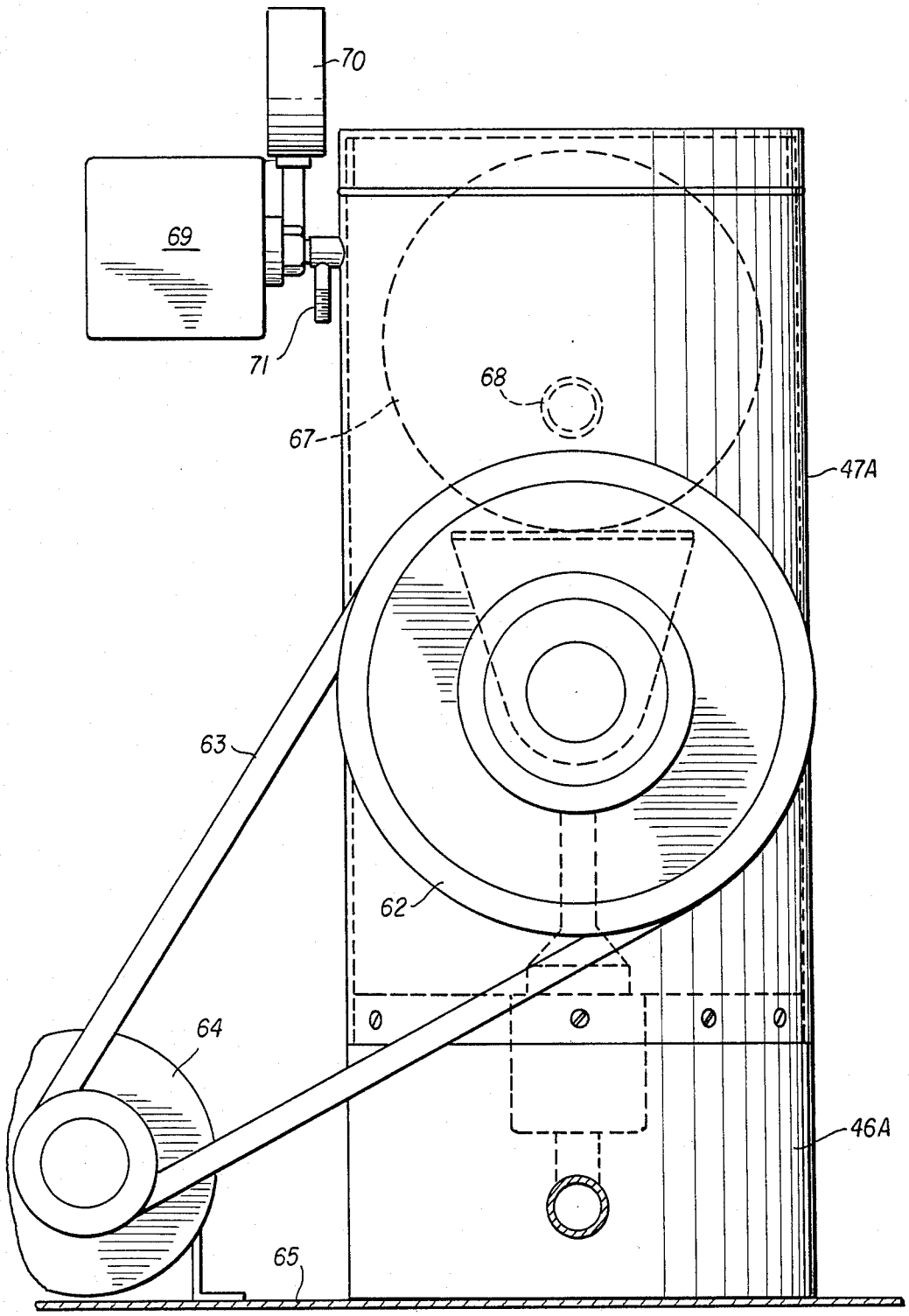
FIG. 5 is a side elevational view of a smaller embodiment of the pump of the present invention with parts shown in dash lines.
Figure 6:
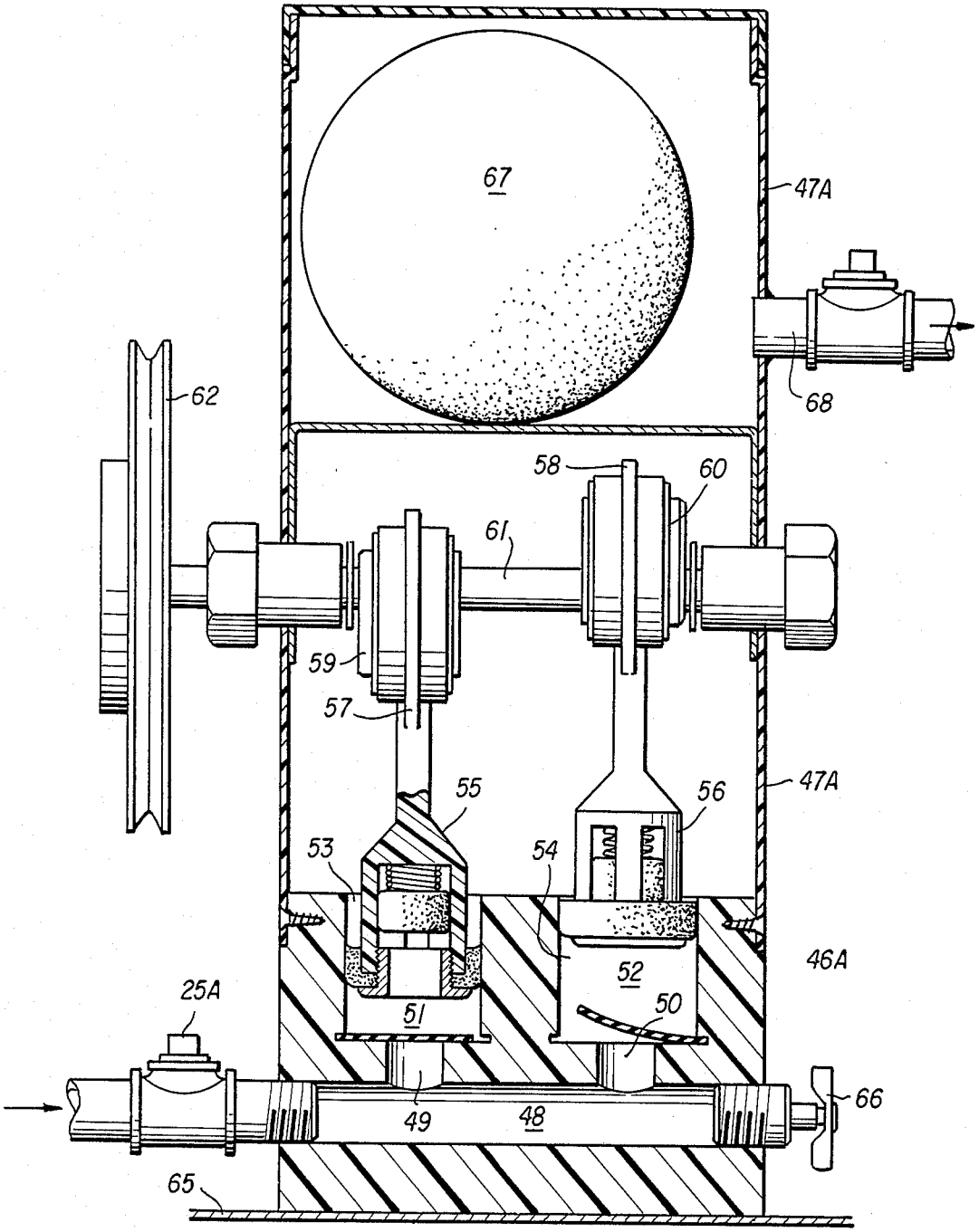
FIG. 6 is a vertical sectional view of the pump of FIG. 5 taken from the right hand end of FIG. 5 with parts broken away and parts shown in section.

To pump water with the embodiemnt of FIGS. 5 and 6 the water supply valve 25A is opened and the air vent valve 66 is closed, whereas to pump air, the vent valve 66 is opened and the water supply valve 25A is closed.

Referring now to FIGS. 5 and 6 a smaller more transportable version of the pump is shown wherein the reservoir 46A is of a solid plastic cylinder and the header tank 47A is of a transparent plastic cylinderical tube. The solid base 46A is bored out at 48 and has a water source connection 49 from a well or other source of water. The bore 48 communicates with two vertical bores 49, 50 leading to two larger diameter bores 51, 52 which form the cylinders 53, 54 to receive pistons 55, 56 connected through staps 57, 58 driven by eccentrics 59, 60 on drive shaft 61 driven by pulley 62 through a belt and motor drive 63, 64 mounted on a base 65. This is the same cylinder and piston pump arrangement shown in FIGS. 1 through 4.

Figure 4:
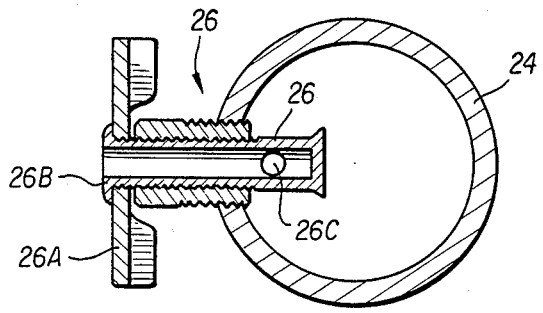
FIG. 4 is a vertical sectional view through the air inlet valve taken on the lines 4—4 in FIG. 1.

An air valve 66 simular to that shown in FIG. 4 is connected at the end of bore 48 for the same purpose as that of air valve 26 in FIG. 1, to supply air for pumping in lieu of water to blow out the distribution system and to supply service air for inflating marine devices and blowing out filters etc.

In place of the variably inflatable bladder 44 shown in FIG. 1, a compressible ball-like member 67 is employed. A water discharge nipple 68 extends from the tank wall 47A above the drive shaft 61 and the working parts of the pump and in all other respects the smaller pump of FIGS. 5 and 6 is substantially the same as the structure shown in FIGS. 1 through 4 except for size and materials.

A pressure control switch 69 communicates with the interior of tank 47A as does a pressure guage 70 and external charging connection 71 similar to that shown in FIG. 1 for service air.

The supply of air in place of water is obtained by closing a water supply valve FIG. 1, supplied by the customer, and opening the air valve 26, FIG. 4 by rotating spinner lever 66 causing the threaded valve shaft 26B to expose the air port 26C, the desired amount to permit the pistons 55,56 to draw in air in lieu of water to charge the tank 47A and ultimately to supply air to blow out the distribution system to remove all water from pipes winterizing the system and protecting it from freezing.

The air valve 71 may be employed to supply service air for blowing up marine devices such as inflatable tubes and other marine accessories.

What we claim is:

1. A pumping system comprising a substantially flat based primary reservoir, a header tank and a pump, said pump comprising, (a) at least a pair of reciprocating pistons powered by a motor driven shaft passing through said tank and in pumping communication with said primary reservoir, (b) eccentric drive cams directly connected to said motor driven shaft and connected to drive said pistons to pump water from said reservoir into said tank, (c) a water supply connection connected horizontally to said reservoir, and a water supply value therein having an open and closed position, (d) a tank discharge connector for connection to a water service system through the side wall of said tank externally thereof above said motor driven shaft and its direct drive connection with said pistons to lubricate said driving connection, (e) and an air inlet valve communicating with said water supply connection horizontally entering said reservoir externally thereof downstream of said water supply valve to permit pumping of air when said water supply valve is closed and said air inlet valve is open.

2. A pumping system as claimed in claim 1 wherein said motor driven shaft is a rotary shaft.

3. A pumping system as claimed in claim 2 wherein said reservoir has a volumetric capacity less than said header tank.

4. A pumping system comprising of substantially flat base bowl or water receiving chamber, a header tank and a pump, (a) at least one reciprocating piston powered by a motor driven shaft passing through said tank, (b) eccentric drive cam means directly connected to said motor driven shaft and connected to drive said piston to pump water from said bowl into said tank, (c) a water supply connection connected horizontally to said flat base bowl, having a water supply valve therein having an open and closed position, (d) a tank discharge connection to a water service system through the side wall of said tank externally thereof above said motor driven shaft and its direct drive connection with said piston to water lubricate said driven connection, (e) and an air inlet valve in the water supply connection entering said bowl horizontally thereof downstream of said water supply valve to permit pumping air when said water supply valve is closed and said air inlet valve is open.

5. A pumping system as claimed in claim 4 further comprising a compressible air filled bladder-like container mounted in said heater tank for protection of said tank from hydraulic lock or accidental freezing of the water in said tank or system.

6. A pumping system as claimed in claim 5 wherein said bladder-like container is variably inflatable.

7. A water/air pumping system comprising a substantially flat reservoir, a header tank and a pump, (a) at least one reciprocating piston powered by a motor driven shaft passing through said tank, (b) eccentric drive cam means directly connected to said motor driven shaft and connected to drive said piston to pump water/air from said reservoir into said tank, (c) a water/air supply connection connected horizontally to said reservoir, and a water supply control valve having an open and closed position, (d) a tank discharge valve to a water/air service system through the side wall of said tank externally thereof, above said motor driven shaft and its direct drive connection with said piston, (e) and an air inlet valve downstream of said water supply control valve in the water/air supply connection entering said reservoir externally thereof to permit pumping air in lieu of water when said water valve is closed and said air valve is open.

8. A pumping system comprising, (a) a substantially flat base cylindrical block having a primary water receiving bore partially horizontal therethrough communicating with at least one cylinder bore, (b) a header tank mounted above said base block, (c) at least one reciprocating piston powered by a motor driven shaft passing through said header tank, and said piston being reciprocatable in said cylinder bore of said base block, (d) eccentric drive cam means directly connected to said motor driven shaft and connected to drive said piston to pump water from said base block into said tank, (e) a tank discharge connector for connection to a water/air service system through the wall of said header tank externally thereof above said motor driven shaft and its direct drive connector with said piston to lubricate said driving connection, a water supply valve having an open and closed position communicating with the horizontal bore in said base block and an air inlet valve communicating with the horizontal bore downstream of said water supply valve to permit pumping of air when said water supply valve is closed and said air inlet valve is open.

9. A pumping system as claimed in claim 8 wherein there are a pair of cylinder bores in said flat base cylinder block to accomodate two pistons, one in each cylinder bore, driven by two eccentrices directly connected to said drive shaft.

* * * * *